United States Patent [19]

Boening

[11] 4,276,757

[45] Jul. 7, 1981

[54] JEWELRY SUPPORT

[76] Inventor: John H. Boening, 250 S. Main St., Frankenmuth, Mich. 48734

[21] Appl. No.: 156,558

[22] Filed: Jun. 5, 1980

[51] Int. Cl.[3] ..... A44C 25/00; A44C 3/00

[52] U.S. Cl. ..... 63/1 R; 63/20

[58] Field of Search ..... 63/2, 1, 20; 24/13

[56] References Cited

U.S. PATENT DOCUMENTS

| | | | |
|---|---|---|---|
| 645,108 | 3/1900 | Lincks | 63/20 X |
| 1,756,041 | 4/1930 | Vance | 63/1 R |
| 2,274,269 | 2/1942 | Jellinek | 63/1 R |
| 2,548,140 | 4/1951 | Bohlinger | 63/1 R |
| 2,930,209 | 3/1960 | Altman | 63/1 R |

FOREIGN PATENT DOCUMENTS

| | | | |
|---|---|---|---|
| 835586 | 9/1938 | France | 63/1 R |

*Primary Examiner*—F. Barry Shay

*Attorney, Agent, or Firm*—Learman & McCulloch

[57] ABSTRACT

A support for enabling a pinstem, plaque-type article of jewlery to be suspended from a neck encircling chain comprises a body section having four springy, arched arms or legs radiating therefrom. Two opposite arms have fingers provided with pinstem-accommodating openings and the other two arms or legs are adapted to bear on plaque. To enable the pinstem to pass through the openings in the fingers, the arms having the fingers must be flexed in such manner as to reduce their arch. The pinstem then will bear firmly against the body section and be gripped tightly by the edges of the fingers adjacent respective openings.

11 Claims, 5 Drawing Figures

JEWELRY SUPPORT

BACKGROUND OF THE INVENTION

Articles of jewelry of the plaque variety conventionally have a mounting pinstem pivoted at one end on a support, the opposite end of the pinstem being adapted for removable accommodation in a keeper spaced from the pivot support. The free end of the pinstem conventionally is tapered or sharpened to pass through a garment so as to enable the plaque separably to be supported on the garment. It often happens, however, that the owner of the plaque would prefer to suspend it from a neck encircling chain like a pendant, rather than attach the plaque to a garment.

It is possible to suspend a plaque from a neck chain simply by looping the chain between the pinstem and the body of the plaque, or by threading the pinstem through a link of the chain. Suspension of a plaque in these ways, however, has certain disadvantages. For example, the plaque will not be capable of assuming a vertical position, but will tilt about a horizontal axis. Further, the plaque more than likely will shift relatively to the chain so as to be suspended from the pivoted end or the latched end of the pinstem. If the plaque is one having a pinstem adapted to extend horizontally when the plaque is attached to a garment, the suspension of such a plaque from a chain thus will cause the decorative design of the plaque to be displaced through approximately 90°.

A further disadvantage of suspending a plaque from a chain simply by looping the chain between the pinstem and the plaque or by threading the pinstem through a link of the chain is that, should the latch inadvertently be opened, separation of the plaque from the chain virtually is a certainty, thereby substantially increasing the likelihood of loss of the plaque.

Various devices heretofore have been proposed for enabling a pinstem plaque to be suspended from a chain. Typical of such proposals are those disclosed in Jellinek U.S. Pat. No. 2,274,269 and Bohlinger U.S. Pat. No. 2,548,140. Although devices of these kinds offer advantages over the simple looping and link threading procedures referred to above, they are not universally adaptable to plaques of different sizes and shapes nor are they capable of providing significant protection against loss of the plaque in the event the pinstem inadvertently should be released from its latch.

An object of the present invention is to provide a support adapted for removable attachment to the pinstem of a plaque so as to enable the plaque to be suspended like a pendant from a chain, the support being adaptable to plaques of different shapes and sizes and enabling the plaque to assume a substantially vertical position when suspended. Another object is to provide a plaque support which affords appreciable protection against loss of the plaque in the event the pinstem becomes unlatched.

SUMMARY OF THE INVENTION

A support constructed according to the invention preferably is of cruciform configuration having four resiliently flexible or springy arms or legs radiating from a center section, all of the arms being inclined toward one side of the plane of the center section. Two opposite arms terminate adjacent their ends in fingers that are reversely bent and extend to the opposite side of the plane of the center section, each of the fingers having an opening therein for the accommodation of the pinstem of a plaque. The sizes and positions of the openings are such that the arms provided with the fingers must be flexed to enable the pinstem to pass through both of the openings. Following insertion of the pinstem through both of the openings the resiliency of the flexed arms causes the pinstem to be gripped frictionally by the center section and by the fingers adjacent the edges of the openings, thereby forcibly binding the support and the pinstem to one another. The remaining two arms of the support bear against the body of the plaque on opposite sides of the pinstem to prevent relative rotation between the support and the plaque. One of these arms is equipped with a loop through which a chain may be threaded, thereby enabling the plaque to be suspended from the chain via the support.

DESCRIPTION OF THE DRAWINGS

A support constructed in accordance with a preferred embodiment of the invention is illustrated in the accompanying drawings, wherein.

DETAILED DESCRIPTION

Figure 1:
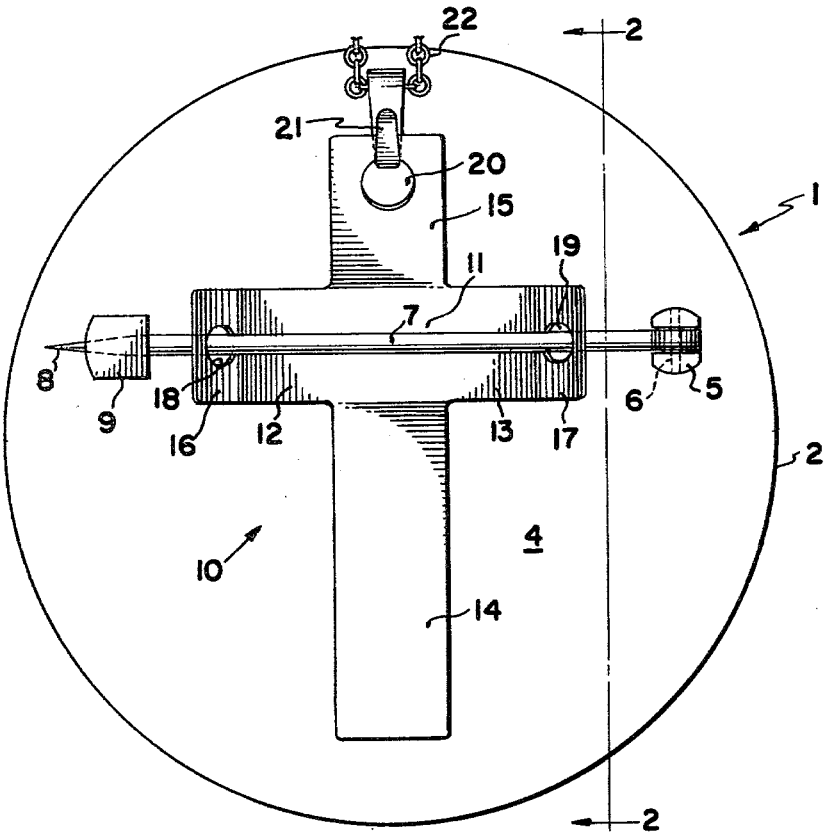
FIG. 1 is an elevational view of a typical pinstem plaque fitted with a support and suspended from a chain.

A support constructed in accordance with the invention is adapted for use in conjunction with a plaque-type article of jewelry 1 having a body 2 of any size and shape. For convenience of illustration the body 2 is illustrated as comprising a disc having a decorative surface 3 and a rear surface 4 on which is secured a post or lug 5 to which is pivoted, by means of a pivot pin 6, one end of an elongate pinstem 7 having a tapered or sharpened point 8 at its other end. Also mounted on the rear surface 4 of the body 2 is a keeper or latch 9 having a slot for the removable accommodation of the free end of the pinstem 7. The latch 9, if desired, may be equipped with a rotary or other type safety catch (not shown) of conventional construction.

The plaque 1 is adapted to be secured to a garment by removing the free end 8 of the pinstem from the keeper 9, and extending the pinstem at two spaced points through the garment, following which the free end of the pinstem may be fitted into the latch to enable the plaque to be supported by the garment.

When it is desired to suspend the plaque from a neck encircling chain or the like, a support 10 constructed in accordance with the invention may be used as the means for coupling the plaque to the chain. The support 10 preferably is stamped from a flat sheet of springy, resiliently flexible metal and is of cruciform configuration, in plan, having a planar, center or body section 11 at the intersection of two pairs of arms or legs 12, 13 and 14, 15 radiating in opposite directions, respectively, from the body section. Each of the two arms 12 and 13 is bent or inclined downwardly from the body section 11 and to the same side of the plane of the body section, as a consequence of which the arms 12 and 13, together with the center section 11, are substantially concavo-convex or arched. Each of the legs 14 and 15 similarly is bent and inclined to the same side of the plane of the center section 11 so that such legs, together with the center section, also have a concavo-convex or arched configuration.

The arm 12 is reversely bent adjacent its free end to form a finger 16 which is inclined toward and beyond the plane of the body section 11, and the arm 13 is similarly reversely bent adjacent its free end to form a finger 17 similar in all respects to the finger 16. The arms 12 and 13 are provided with openings 18 and 19, respectively.

The leg 15 has an opening 20 adjacent its free end for the accommodation of a ring 21 through which a chain 22 may be passed.

Figure 4:
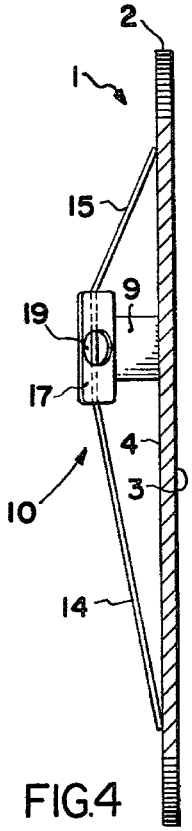
FIG. 4 is a view similar to FIG. 2, but illustrating the support prior to its attachment to the plaque pinstem.
Figure 5:
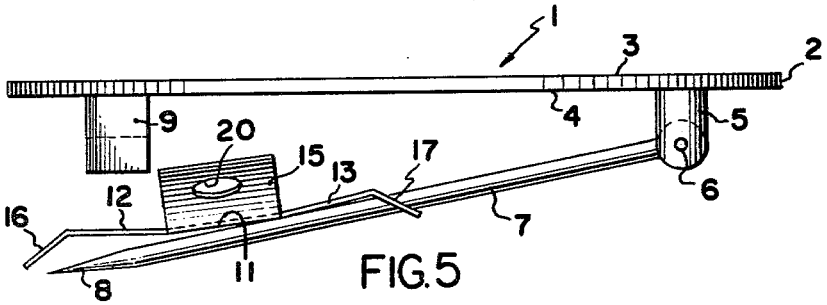
FIG. 5 is an end elevational view similar to FIG. 3 and illustrating the manner of assembling the support and the plaque pinstem.

When the support 10 and the plaque 1 are assembled, the support 10 is oriented in such manner that the free ends of the legs 14 and 15 confront and bear against the rear surface 4 of the plaque, as is shown in FIG. 4. In the unflexed condition of the arms of the support, the relative positions of the fingers 16, 17 and the body section 11 are such that the plane of the latter passes through the openings 18 and 19, as is shown in FIG. 4. The length of each of the fingers 16 and 17 is such that, when the arms 12 and 13 of the support are in their unflexed condition, the pinstem 7 may pass through one of the openings in the fingers, but cannot pass through both of the openings. See FIG. 5. When assembling the plaque 1 and the support 10, therefore, the pinstem is swung outwardly or away from the plaque and inserted through the opening 19 to confront the convex side of the arms 12 and 13, as shown in FIG. 5, following which the arms 12 and 13 are flexed to reduce their arch or convexity and to permit passage of the pinstem 7 through the opening 18 of the finger 16. The flexure of the arms 12 and 13 thus will cause the pinstem 7 to bear firmly against the convex side of the body section 11, and the terminal end portions of the fingers 16 and 17 adjacent the openings 18 and 19 will grip the pinstem 7 in a binding relationship so as to require the exertion of substantial force on the support 10 to effect sliding or rotary movement of the latter relative to the pinstem 7.

Figure 3:
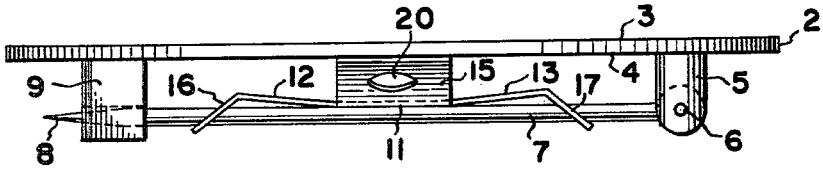
FIG. 3 is an end elevational view as viewed from the upper edge of FIG. 1.
Figure 2:
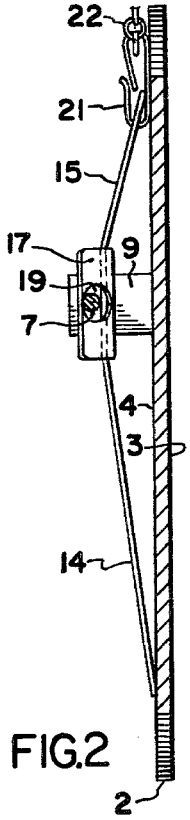
FIG. 2 is a sectional view taken on the line 2—2 of FIG. 1.

Following insertion of the pinstem 7 through the opening 18 in the finger 16 the support 10 may be centered on the pinstem 7 and the free end of the latter moved into the latch 9, as shown in FIG. 3. As the pinstem 7 is moved toward the plaque body 2 to fit the pinstem into the latch 9, the free ends of the legs 14 and 15 will bear against the rear surface 4 of the plaque body and be flexed and stressed so as to maintain the ends of the legs 14 and 15 firmly against the rear surface 4 of the plaque body. This is the condition of the parts shown in FIG. 2. As a consequence, when the plaque is suspended from the chain 22 via the support 10, the plaque will assume a substantially vertical position and the pinstem 7 will be supported in a substantially horizontal position.

In the disclosed embodiment the arms 12 and 13 of the support are of uniform length, the leg 14 is the longest, and the leg 15 is the shortest. The reason for this arrangement is that most pinstem plaques have the pinstem located at a level above the center of the plaque so that, when the plaque is supported on a garment, it will lie fairly flat against the garment. The length of the lower leg 14, therefore, can be longer than that of the upper leg 15 so as to provide the greatest stability for the plaque when the latter is fitted with the support. Should the leg 14 be too long for its particular plaque, however, it is a simple matter for the user to cut off a portion of the free end of the leg 14.

Inasmuch as the legs 14 and 15 are of different lengths, the inclination of the shorter leg is greater than that of the longer leg to enable the free ends of the legs to terminate in the same plane and bear with substantially equal force on the plaque body.

Since the pinstem 7 constantly is in engagement with the body section 11 and constantly is in binding engagement with the fingers 16 and 17, the frictional forces with which the support 10 is retained on the pinstem 7 are sufficient to maintain the support and pinstem assembled even should the pinstem inadvertently be released from the latch 9. Consequently, the risk of loss of the plaque is minimized greatly.

The disclosed embodiment is representative of a presently preferred form of the invention, but is intended to be illustrative rather than definitive thereof. The invention is defined in the claims.

I claim:

1. A support for use in converting an article of jewelry having a mounting pin to a pendant capable of being suspended from a chain or the like, said support comprising an elongate, resiliently flexible concavo-convex arm terminating at its opposite ends in fingers bent to extend beyond the convex side of said arm, each of said fingers having an opening therein for the accommodation of said pin, and means for attaching said arm to a chain or the like, the sizes and positions of said openings in said fingers being such that alignment of said openings for enabling insertion of said pin through both of said openings requires flexure of said arm to reduce its concavity, the resiliency of said arm enabling the latter to bear firmly against said pin and urge those portions of said fingers at the edges of the respective openings into engagement with said pin.

2. A support according to claim 1 wherein said arm has a central portion which is substantially flat and inclined end portions extending in opposite directions from said central portion.

3. A support according to claim 1 wherein said attaching means comprises a finger joined to and extending transversely from said arm.

4. A support according to claim 1 including at least one stabilizer leg for engagement with said article of jewelry, said leg being joined to said arm between said fingers and inclined toward the concave side of said arm.

5. A support according to claim 1 including a pair of stabilizer legs for engagement with said article of jewelry, said legs being joined to said arm between said fingers and extending transversely from said arm in opposite directions, each of said arms being inclined toward the concave side of said arm.

6. A support according to claim 5 wherein said legs are of different length.

7. A support according to claim 6 wherein the degree of inclination of said legs is different.

8. A support according to claim 7 wherein the inclinations of said legs are such that those ends thereof remote from said arm terminate substantially in the same plane.

9. A support for use in converting an article of jewelry having a mounting pin to a pendant capable of being suspended from a chain or the like, said support comprising a cruciform member having four substantially normal, resiliently flexible arms radiating from a substantially planar central section, all of said arms being inclined in a first direction toward one side of the plane of said center section, two of said arms extending in opposite directions from said center section terminating in fingers bent in a direction away from said first direction and toward the plane of said center section, each of said fingers having an opening therein for the accommodation of said pin, the length and inclinations of each of said two arms being such as to require flexure of said two arms toward the plane of said center section to align said openings and enable said pin to be accommodated in both of said openings.

10. A support according to claim 9 including means carried by an arm other than said two arms for coupling said cruciform member to a chain.

11. A support according to claim 9 wherein said fingers extend from said one side of said plane beyond the opposite side thereof.

* * * * *